US006851286B2

(12) United States Patent
Dubé et al.

(10) Patent No.: US 6,851,286 B2
(45) Date of Patent: Feb. 8, 2005

(54) FRONTAL LATCH HANDLE ASSEMBLY

(75) Inventors: Claude Dubé , La Pocatière (CA); Marc Laurendeau, Saint-Jean-Port-Joli (CA)

(73) Assignee: Rousseau Metal Inc., Montreal (CA)

( * ) Notice: Subject to any disclaimer, the term of this patent is extended or adjusted under 35 U.S.C. 154(b) by 10 days.

(21) Appl. No.: 10/211,347

(22) Filed: Aug. 5, 2002

(65) Prior Publication Data

US 2004/0020248 A1 Feb. 5, 2004

(51) Int. Cl.[7] ..... E05B 65/44

(52) U.S. Cl. ..... 70/81; 70/85; 70/86; 70/208; 292/336.3; 312/332.1

(58) Field of Search ..... 70/78–88, 208, 70/210; 312/348.6, 348.4, 330.1, 332.1; 361/724–727, 747; 109/47; 292/336.3, DIG. 31

(56) References Cited

U.S. PATENT DOCUMENTS

| | | | | | |
|---|---|---|---|---|---|
| 492,646 | A | * | 2/1893 | Walker | 200/61.64 |
| 2,944,864 | A | * | 7/1960 | Krivulka | 312/332.1 |
| 3,313,586 | A | * | 4/1967 | McClintock | 312/332.1 |
| 3,574,436 | A | | 4/1971 | Anderson | 312/320 |
| 3,619,019 | A | * | 11/1971 | Hepker | 312/332.1 |
| 4,003,614 | A | * | 1/1977 | Geer et al. | 312/332.1 |
| 4,040,695 | A | * | 8/1977 | Brann | 312/348.6 |
| 4,113,292 | A | * | 9/1978 | Gauron et al. | 292/165 |
| 4,366,997 | A | * | 1/1983 | Lopez et al. | 312/204 |
| 4,525,012 | A | | 6/1985 | Dünner | 312/222 |
| 5,208,735 | A | * | 5/1993 | Twachtmann et al. | 361/725 |
| 5,292,191 | A | | 3/1994 | Slivon | 312/332.1 |
| 5,388,902 | A | | 2/1995 | Huebschen et al. | 312/332 |
| 5,403,139 | A | | 4/1995 | Slivon et al. | 312/332.1 |
| 5,443,311 | A | | 8/1995 | Kadlecek et al. | 312/308 |
| 5,445,451 | A | | 8/1995 | Harmony | 312/333 |
| 5,765,933 | A | * | 6/1998 | Paul et al. | 312/332.1 |
| 5,791,753 | A | * | 8/1998 | Paquin | 312/332.1 |
| 5,795,044 | A | | 8/1998 | Trewhella, Jr. et al. | 312/333 |
| 5,797,667 | A | * | 8/1998 | Wu | 312/332.1 |
| 5,819,139 | A | * | 10/1998 | Harlan et al. | 399/110 |
| 5,823,649 | A | | 10/1998 | Hinrichs | 312/334.45 |
| 5,828,548 | A | * | 10/1998 | Chen | 361/685 |
| 5,868,478 | A | | 2/1999 | Yemini | 312/332.1 |
| 6,231,145 | B1 | * | 5/2001 | Liu | 312/332.1 |
| 6,375,235 | B1 | | 4/2002 | Mehmen | 292/128 |
| 6,431,615 | B1 | * | 8/2002 | Bastian | 292/80 |
| 6,431,616 | B1 | * | 8/2002 | Julian | 292/171 |
| 6,527,353 | B1 | * | 3/2003 | Bradfish et al. | 312/332.1 |
| 6,547,289 | B1 | * | 4/2003 | Greenheck et al. | 292/126 |
| 2002/0017840 | A1 | * | 2/2002 | Huw-Ching et al. | 312/348.6 |

FOREIGN PATENT DOCUMENTS

| | | | |
|---|---|---|---|
| DE | 257509 | * | 3/1913 |

* cited by examiner

*Primary Examiner*—Lloyd A. Gall
(74) *Attorney, Agent, or Firm*—McDermott Will & Emery LLP

(57) ABSTRACT

A frontal latch handle assembly for operating a drawer of a cabinet. The latch handle assembly has a handle member and a mounting arrangement for movably mounting the handle member on a front panel of the drawer so that the handle member is movable between first and second positions. The assembly is provided with a latching arrangement having a block member mountable on the front panel of the drawer and a latch member movable with respect to the block member between a lock position wherein opening of the drawer is prevented by engaging the latch member with the cabinet, and an unlock position wherein the opening of the drawer is allowed. A mechanism responsive to movement of the handle member is provided for moving the latch member between the lock and unlock positions.

21 Claims, 12 Drawing Sheets

FRONTAL LATCH HANDLE ASSEMBLY

FIELD OF THE INVENTION

The present invention relates to latching devices for drawers, and more particularly to a frontal latch handle assembly for operating a drawer of a cabinet and preventing undesired opening of the drawer without necessarily locking it.

BACKGROUND

The sliding drawers of a cabinet like those which are used for the storage of tools and mechanical parts may undesirably open due to vibrations for example when the cabinet is placed in a truck or when it is provided with wheels. The undesired opening of the drawers may be prevented when they are provided with key locks, which is often the case. However, all the drawers must be locked and eventually unlocked each time the cabinet is moved, without mentioning the need of having the required key(s).

It is thus desirable to provide some kind of latching devices which would prevent the undesired opening of the drawers without necessarily locking them. There are certain latching devices designed for this purpose.

For example, known in the art is U.S. Pat. No. 4,525,012 (Dünner) which shows a latching device having a button at the front of the drawer which actuates a cam at the rear of the drawer. The major drawback of this type of mechanism is that two hands must generally be used to open the drawer, one for operating the button and one for pulling the drawer's handle.

Other latching devices have a button integrated at one end of the drawer's handle. The mechanism can be operated with a single hand but the button is not accessible over the whole length of the handle.

Also known in the art is U.S. Pat. No. 5,403,139 (Slivon et al.), which describes a latching device having a drawer pull at the front of the drawer. The pull has a bottom channel in which a latch bar slides as it is finger driven in the proper direction to unlatch the drawer and is urged back into a latching position by a spring as soon as the user releases the latch bar.

Also known in the art is U.S. Pat. No. 5,292,191 (Slivon), which describes a latching device in the form of a hook mounted near an end of the drawer's handle and engaging with a keeper structure in one side of the cabinet by downward swivelling caused by a spring.

Known in the art are U.S. Pat. No. 6,375,235 (Mehmen), U.S. Pat. No. 5,868,478 (Yemini), and U.S. Pat. No. 5,445,451 (Harmony) which all show latching devices similarly operating based on a hooking element projecting inside the drawer and releasably engaging with a complementary hooking structure over the drawer inside the cabinet.

Other examples of latching devices are shown in U.S. Pat. No. 3,574,436(Anderson), U.S. Pat. No. 5,443,311 (Kadlecek et al.), U.S. Pat. No. 5,388,902 (Huebschen et al.), U.S. Pat. No. 5,795,044 (Trewhella, Jr et al.), and U.S. Pat. No. 5,823,649 (Hinrichs).

However, all of the above devices have some drawbacks, for example: it cannot be operated with a single hand and if so, it is not ambidextrous; it cannot be operated along the full width of the drawer; its operation is not user-friendly or transparent for the user; it interferes with the drawer's slides; its operation depends on the user action on the handle; etc.

SUMMARY

An object of the present invention is to provide a latch handle assembly which is easily mountable onto a drawer for preventing undesired opening of the drawer without necessarily locking it.

Another object of the present invention is to provide such a latch handle assembly which allows the drawer to be opened instinctively with only one hand, either right or left, preferably over the full length of the drawer.

Another object of the present invention is to provide such a latch handle assembly which operates without the user being aware that he/she operated it.

Another object of the present invention is to provide such a latch handle assembly which has a latch not interfering with the slide arrangement of the drawer no matter its height.

Another object of the present invention is to provide such a latch handle assembly which operates even if the operator applies a pressure on the handle to close the drawer.

According to the present invention, there is provided a frontal latch handle assembly for operating a drawer of a cabinet. The latch handle assembly comprises a handle member and a mounting arrangement for movably mounting the handle member on a front panel of the drawer so that the handle member is movable between first and second positions. The assembly is provided with a latching arrangement having a block member mountable on the front panel of the drawer and a latch member movable with respect to the block member between a lock position wherein opening of the drawer is prevented by engaging the latch member with the cabinet, and an unlock position wherein the opening of the drawer is allowed. A mechanism responsive to movement of the handle member is provided for moving the latch member between the lock and unlock positions.

BRIEF DESCRIPTION OF THE DRAWINGS

A detailed description of preferred embodiments will be given herein below with reference to the following drawings, in which like numbers refer to like elements.

DETAILED DESCRIPTION OF THE PREFERRED EMBODIMENTS

Figure 8:
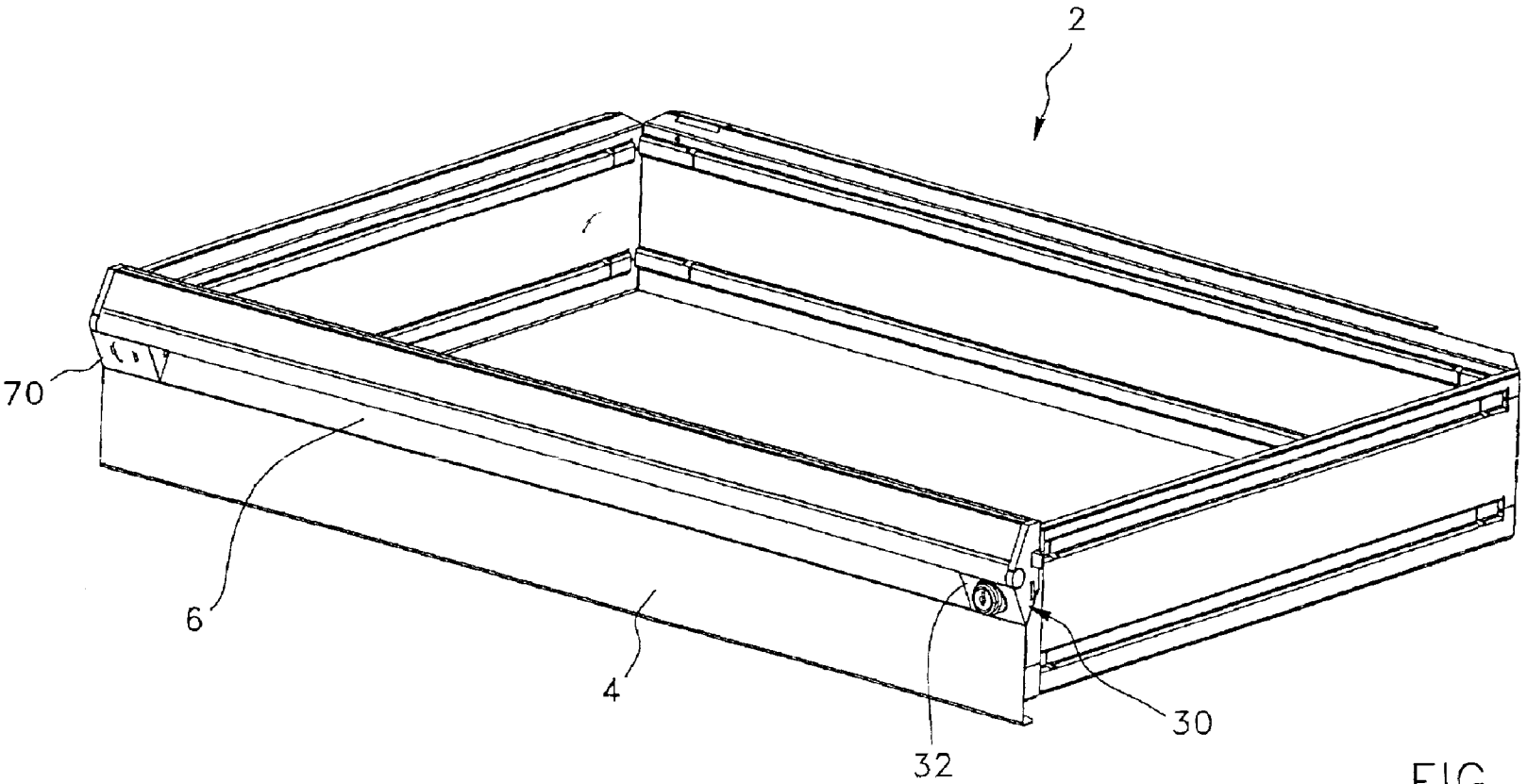
FIG. 8 is a perspective view of a drawer provided with another latch handle assembly according to the present invention.
Figure 9:
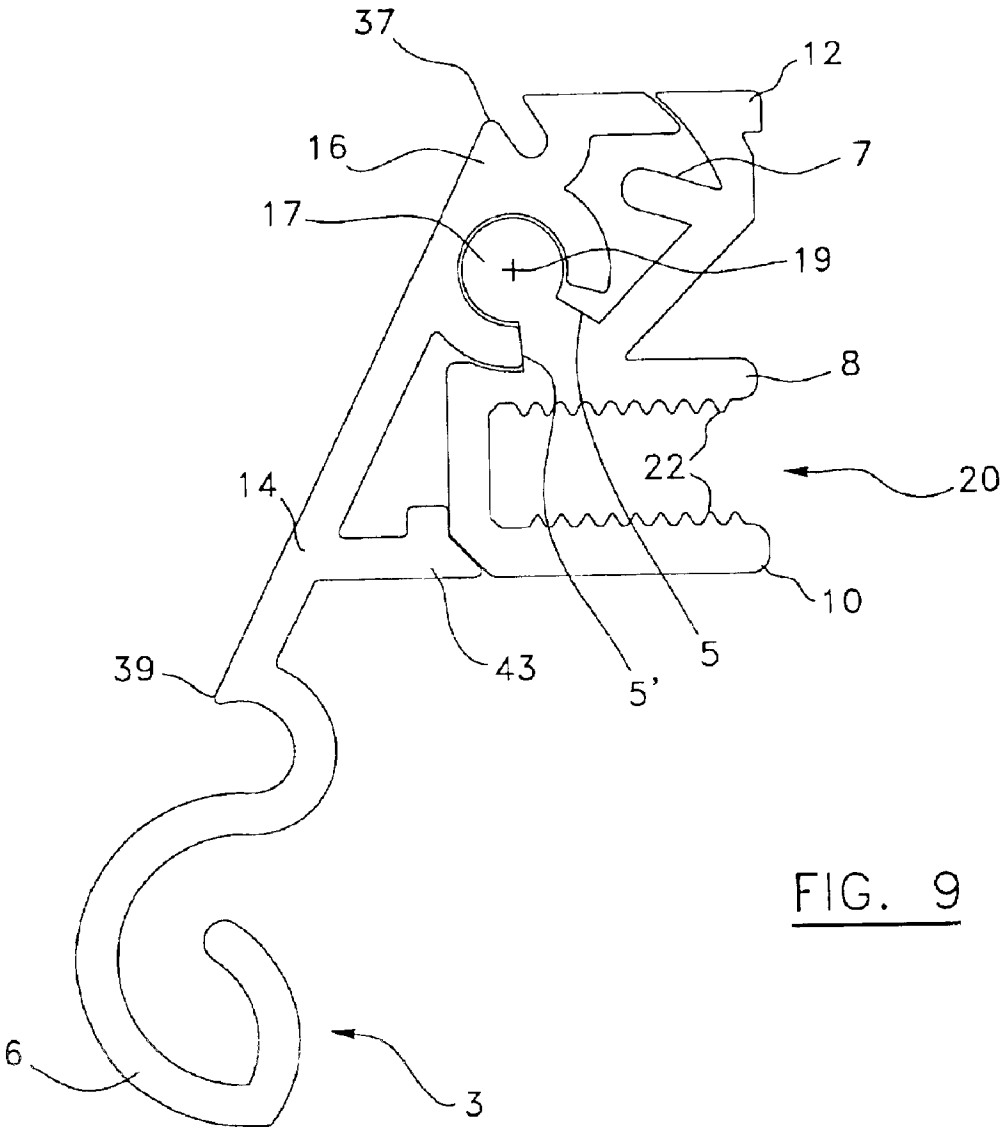
FIG. 9 is a cross-sectional view of another handle member with a mounting bracket of a latch handle assembly according to the present invention.

Referring to FIG. 8, there is shown a frontal latch handle assembly according to the present invention, mounted onto a front panel 4 of a drawer 2. The latch handle assembly comprises a handle member 6, preferably having an elongated shape providing a corresponding extended hand operating surface 3 (as shown in FIG. 9). In the illustrated case, the handle member 6 is mounted over the full width of the drawer 2. The handle member 6 is movably mounted on the front panel 4 of the drawer 2 so as to move between first and second operating positions. A pivotal arrangement mountable on the front panel 4 of the drawer 2 and supporting the handle member 6 is preferably used for this purpose. Other arrangements can be used if desired as, for example, a handle sliding along the front panel 4.

Figure 2:
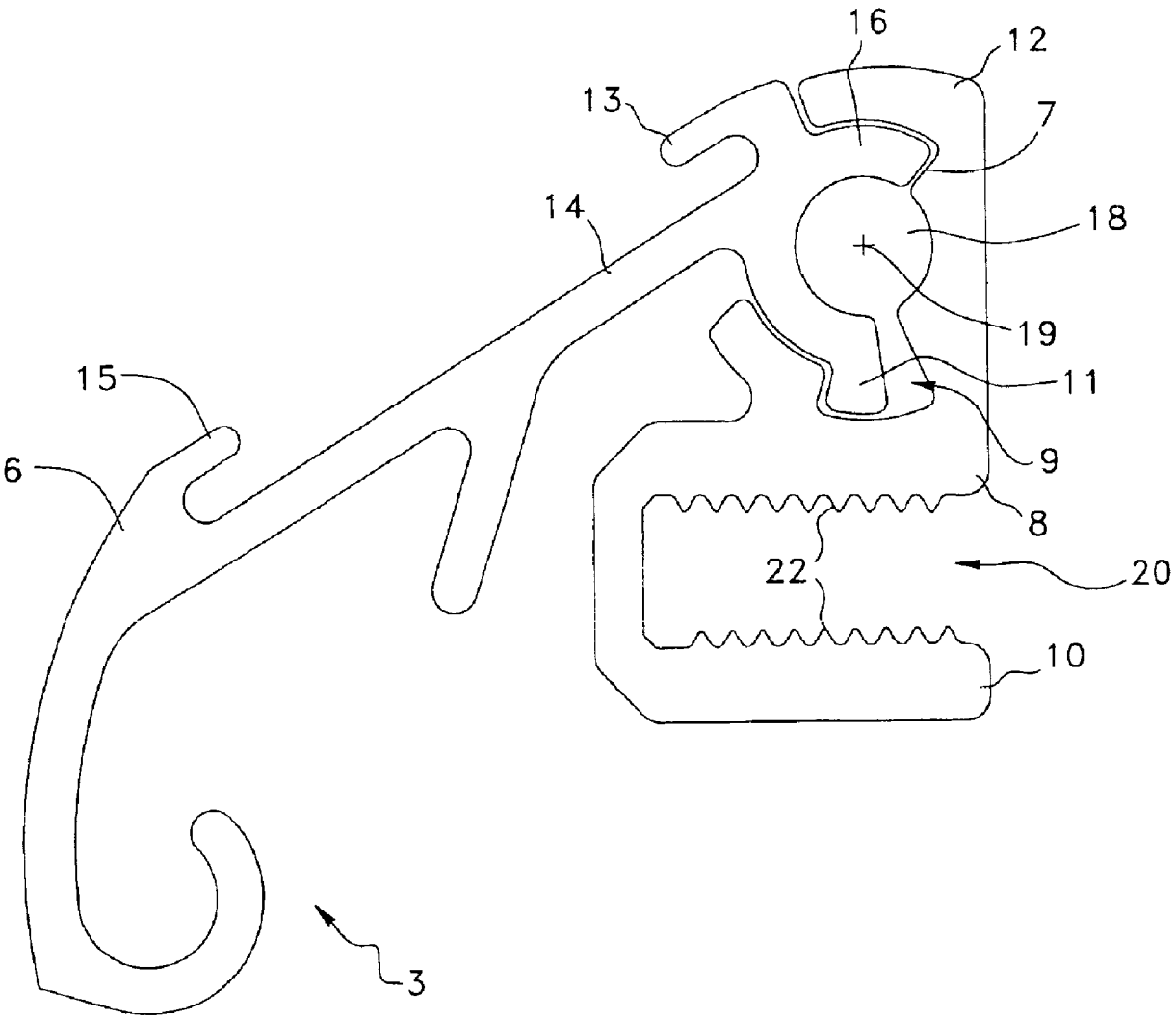
FIG. 2 is a cross-sectional view of a handle member with a mounting bracket of a latch handle assembly according to the present invention.

Referring to FIGS. 2 and 9, the pivotal arrangement may conveniently consist of a pivot member 8 mountable on the front panel of the drawer 2 and having a front side to which the handle member 6 is pivotally connected. The pivot member 8 may be secured to the front panel 4 for example using bolts (not shown) passing through holes 180 see, e.g., (FIG. 10) in the front panel 4 and engaging with opposite inner thread elements 22 in a longitudinal rearward slot 20 formed by a connecting portion 10 of the pivot member 8. Any other suitable connecting arrangements can be used if desired. The pivot member 8 and the handle member 6 may conveniently be made of first and second extrusions 12, 14.

Referring to FIG. 9, the first extrusion 12 is in that case provided with a longitudinal cylindrical pivot element 17 projecting upwardly. The second extrusion 14 is provided with a complementary cylindrical socket 16 pivoting on the cylindrical pivot element 17 so that some degree of pivotal motion about a pivot axis 19 is possible between the extrusions 12, 14. The degree of pivotal motion determines the first and second positions of the handle member 6. For user-friendly operation, the handle member 6 preferably pivots upwardly when operated for opening the drawer. The first extrusion 12 may be provided with two lower stop surfaces 5 and 5' and an upper stop surface 7 limiting the possible pivotal motion of the second extrusion 14. The second extrusion 14 can have a stop member 43 which rests against the front side of the pivot member 8 in the first position of the handle member 6. The second extrusion 14 may have a face provided with opposite edges 37, 39 adapted to receive a label-holder (not shown). The two extrusions 12 and 14 can be made of aluminum or of another type of material such as a steel based material.

Referring to FIG. 2, the first extrusion 12 is in that case provided with an upper longitudinal cylindrical cavity 18. The second extrusion 14 is provided with a rear cylindrical end 16 fitting into the cylindrical cavity 18 so that some degree of pivotal motion about the pivot axis 19 is possible between the extrusions 12, 14. The cavity 18 of the first extrusion 12 can have a lower slot 9 and an upper stop surface 7 limiting the possible pivotal motion of the end 16 of the second extrusion 14 provided with a lower flange 11 moving in the slot 9 for this purpose. The second extrusion 14 may have an upper surface provided with opposite flanges 13, 15 defining a space for insertion of a label or a handle ornament piece (not shown).

Referring to FIGS. 3–5 and 10–12, the latch handle assembly comprises a latching arrangement 30 preferably made of a block member 32 mountable on the front panel 4 of the drawer 2 and a latch member 34 movable with respect to the block member 32 between a lock position and an unlock position. In the unlock position, the latch member 34 is almost if not fully completely withdrawn into the block member 32 for allowing the opening of the drawer 2. In the lock position, an end of the latch member 34 projects out of the latching arrangement 30. Generally, a hole (not shown) made in the side wall of the cabinet will conveniently provide the required catch for the latch member 34 to prevent the opening of the drawer 2. In the case where the cabinet is provided with side walls having inward flanges, then the latch member 34 may engage behind the flange so as to prevent the opening of the drawer 2. In the event that the cabinet has no appropriate stopping surfaces, then an appropriate catch (not shown) may be affixed to its side wall adjacent to the latching arrangement 30 in alignment with the latch member 34 to provide the required stopping surface. The block member 32 preferably guides the latch member 34 along a linear travelling course between the lock and unlock positions. However, depending on the structure and design of the block member 32 and the latch member 34, other operating courses may be used provided that the latch member 34 moves between a lock position in which it engages with the cabinet and an unlock position in which it disengages from the cabinet and allows the opening of the drawer 2.

Figure 4:
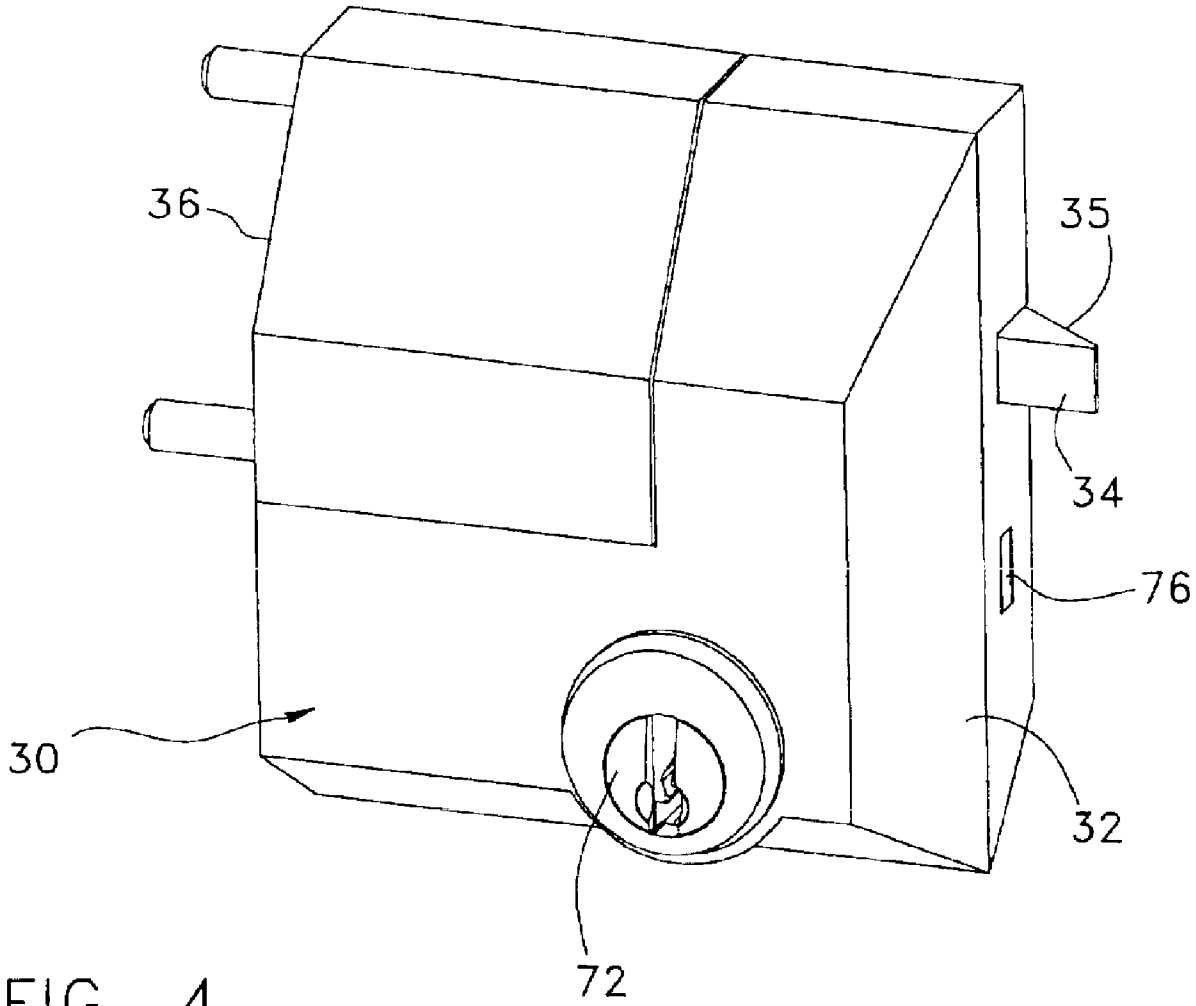
FIGS. 4 and 5 are enlarged perspective views of a latching arrangement of a latch handle assembly according to the present invention, in lock and unlock positions respectively.
Figure 5:
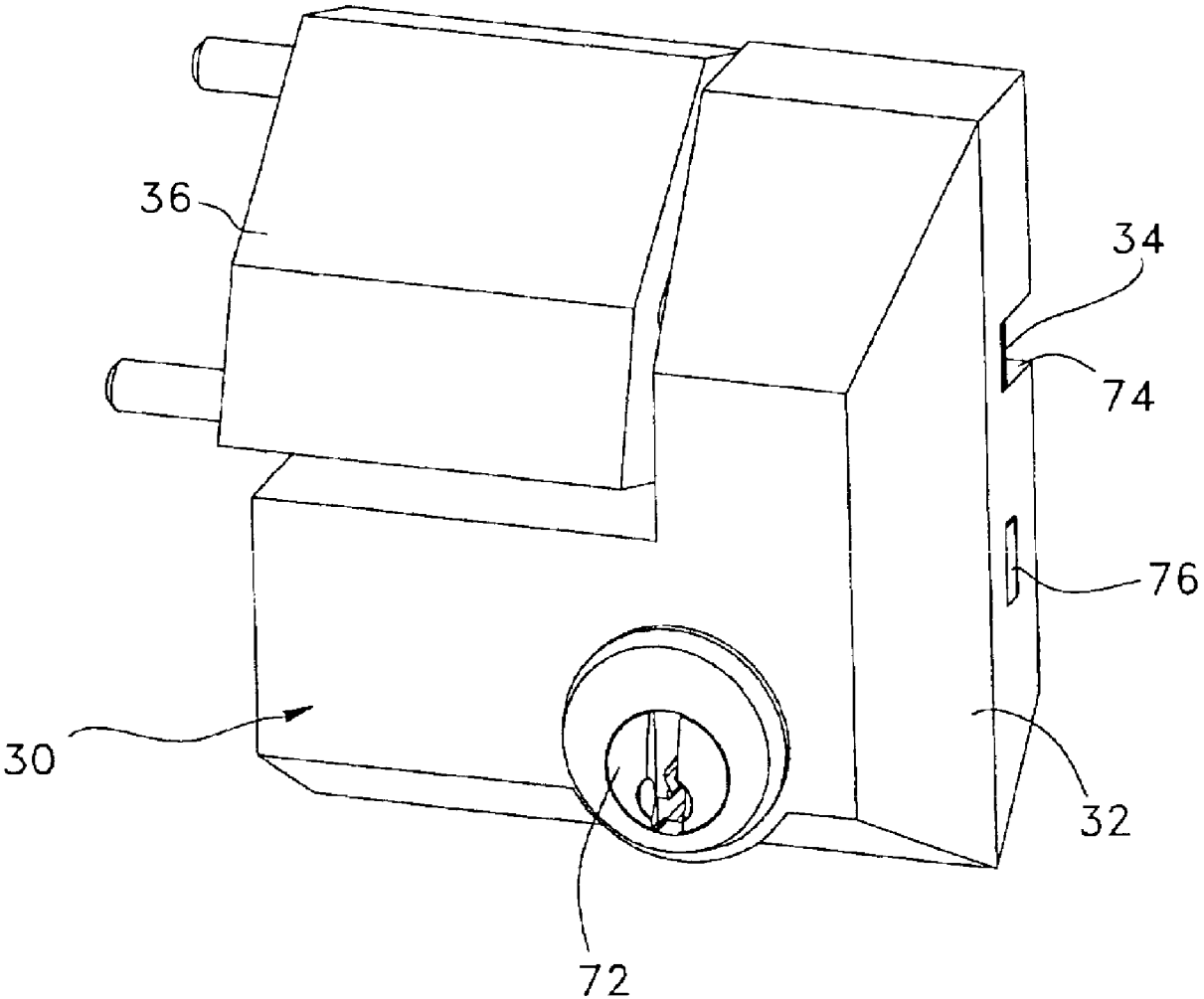
Figure 7:
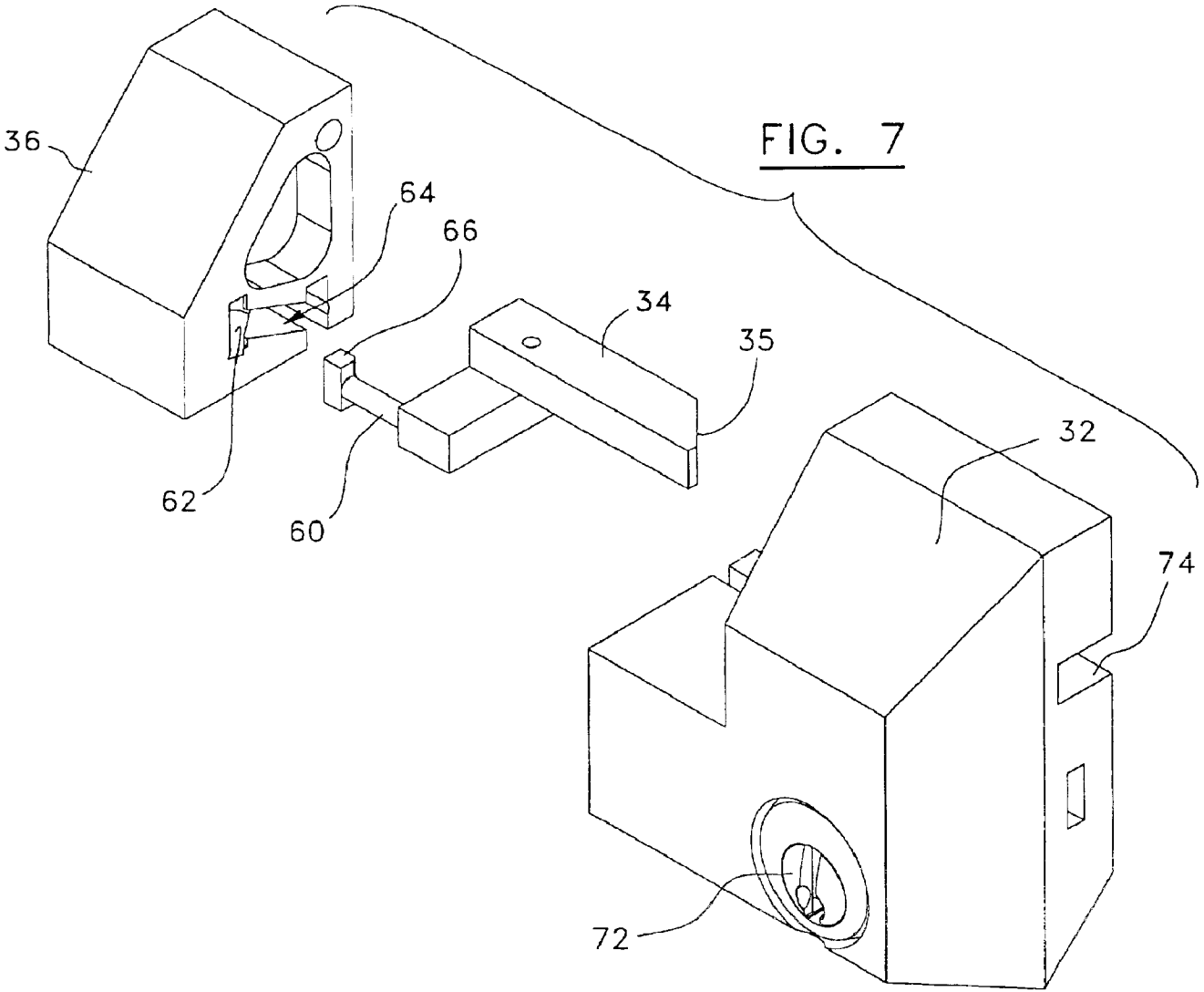
FIG. 7 is an enlarged exploded perspective view of another latching mechanism of a latch handle assembly according to the present invention.
Figure 12:
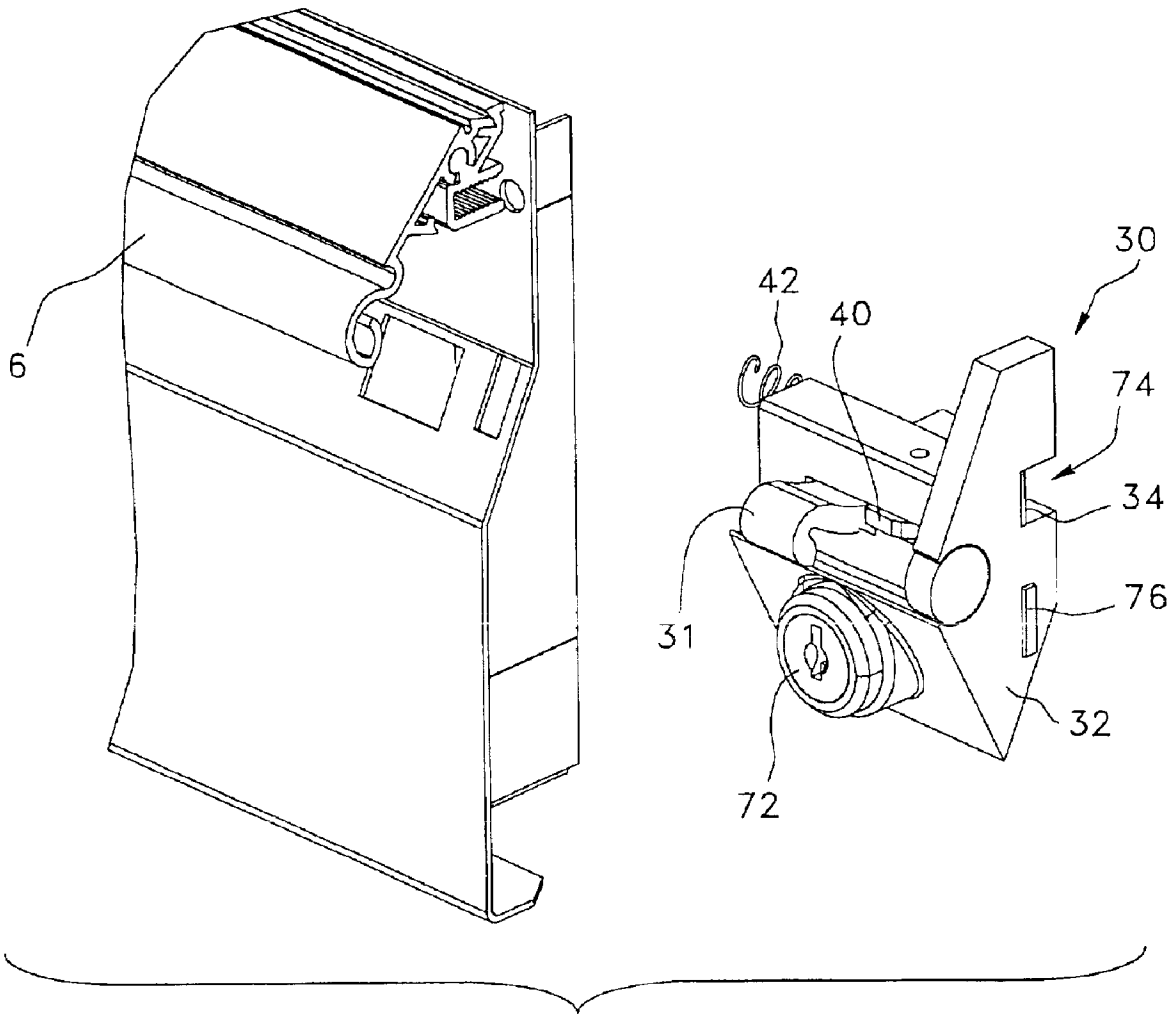
FIG. 12 is an exploded perspective view of a latch handle assembly in unlock position according to the present invention.

Referring to FIGS. 7 and 12, the block member 32 has a back side preferably having a longitudinal slot 74 slideably guiding the latch member 34 along the linear travelling course between the lock and unlock positions as it can be seen on FIGS. 4 and 5 respectively. As indicated above, other convenient ways to guide the latch member 34 between the lock and unlock positions may be considered, for example, so as to effect a rotation of the latch member 34 between the lock and unlock positions.

Referring to FIG. 4, the latch member 34 preferably has an exposed leading bevelled edge 35 engaging with the cabinet when the drawer 2 is closed for facilitating the engagement of the latch member 34 with the cabinet.

Referring to FIGS. 3, 6 and 10–12, a latching mechanism responsive to movement of the handle member 6 is provided for moving the latch member 34 between the lock and unlock positions. The latching mechanism may take various forms depending on the motion and structure of the handle member 6 and the latching arrangement 30. In the illustrated embodiments, the latching mechanism has a rotary cam 40 coupled to the handle member 6 and engaging with the latch member 34 so that the latch member 34 is pulled along the travelling course toward the unlock position by a rotation of the rotary cam 40 resulting from an upward swivelling of the handle member 6 from the first position to the second position.

Figure 3:
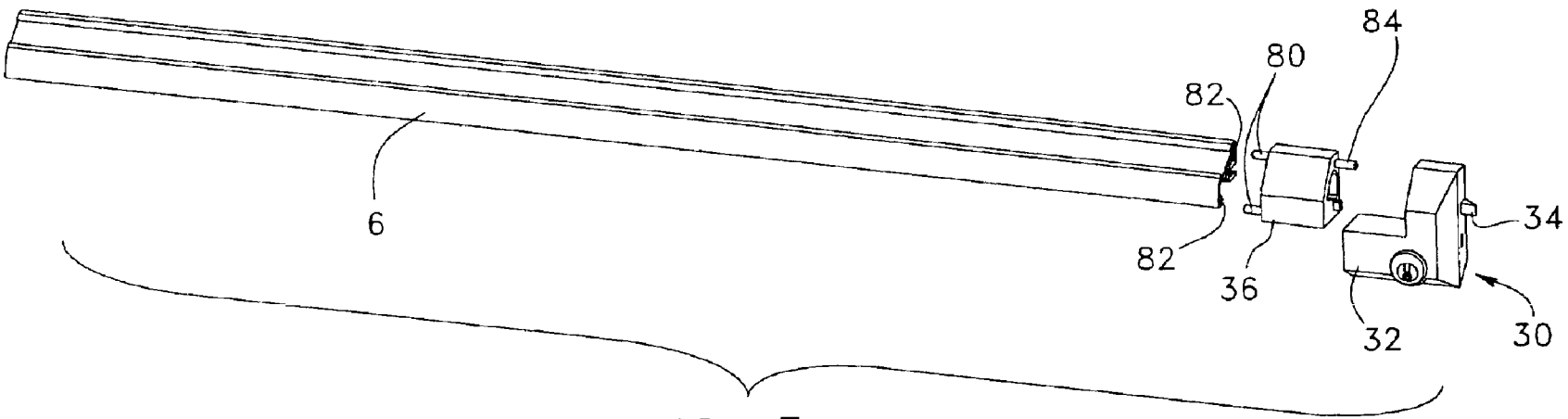
FIG. 3 is an exploded perspective view of a latch handle assembly according to the present invention.
Figure 6:
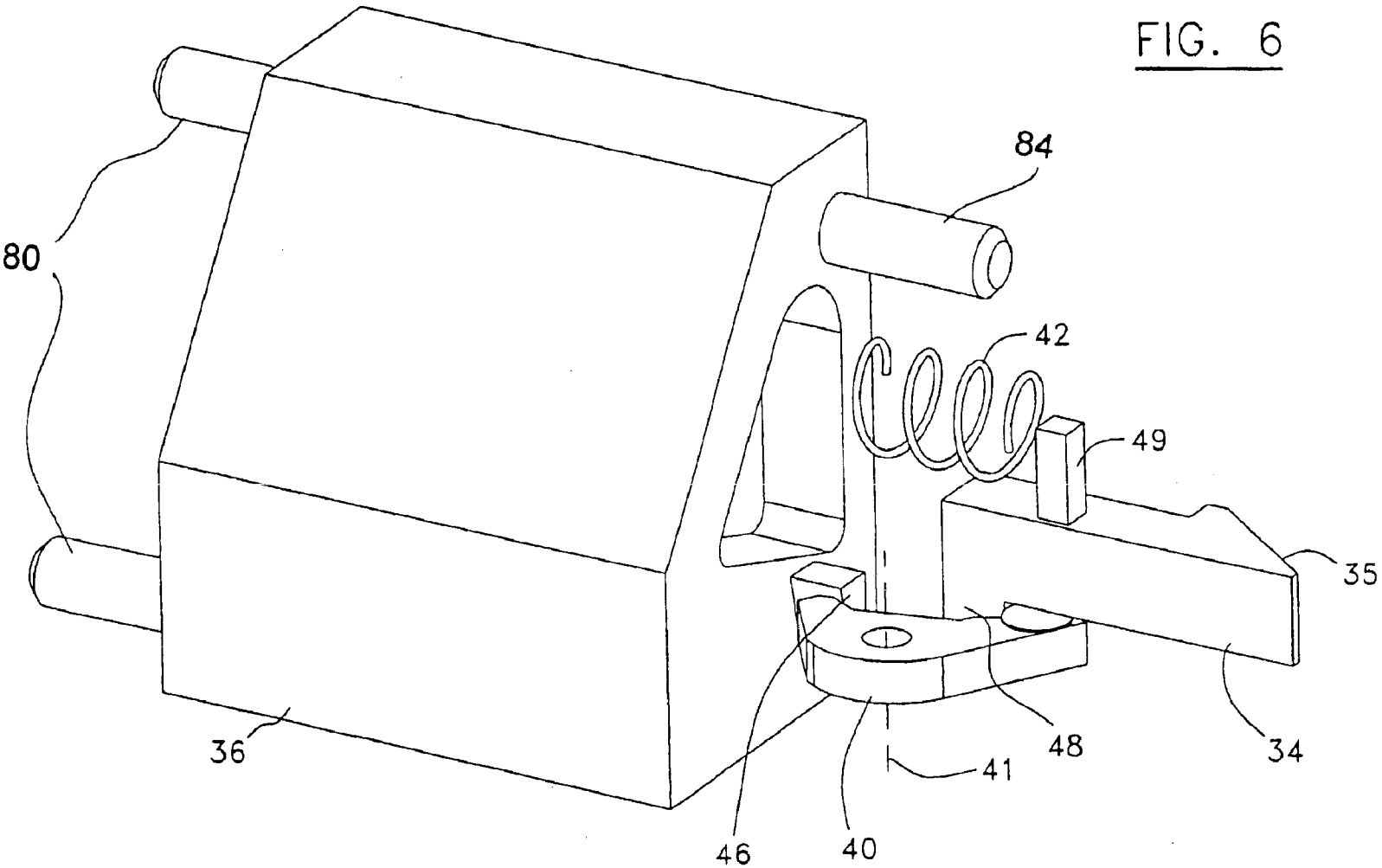
FIG. 6 is an enlarged perspective view of a latching mechanism of a latch handle assembly according to the present invention.

Referring to FIGS. 3 and 6, the coupling of the rotary cam 40 with the handle member 6 can be achieved through a coupling block 36 mounted at an end of the handle member 6 and having an outwardly projecting abutment member 46 directed toward the block member 32 of the latching arrangement 30. The abutment member 46 is in alignment with the latch member 34 when the handle member 6 is in first position, and has a sufficient height to remain in contact with the rotary cam 40 as the coupling block 36 is upwardly pivoted by the handle member 6 during an opening operation. Appropriate engagement of the rotary cam 40 with the latch member 34 may be achieved through a projecting shoulder 48 of the latch member 34. The rotary cam 40 thus has an end pressing sideways against the abutment member 46 of the coupling block 36 and an opposite end hooking the shoulder 48 of the latch member 34. The rotary cam 40 has a rotation axis 41 extending on a side of the travelling course of the latch member 34. The rotary cam 40 is preferably rotatively supported by the block member 32. A spring 42 extends between the coupling block 36 and an upward projection 49 of the latch member 34 for urging the latch member 34 along the travelling course toward the lock position. Other kinds of spring elements and arrangements (e.g. tension, torsion, etc.) can be used for this purpose. Also, no spring at all may be required if the ends of the cam 40 are pinned or otherwise fastened to the coupling block 36 and the latch member 34 so as to act in both directions. However, such an arrangement would require the lowering of the handle member 6 to move the latch member 34 back in lock position unless another mechanism for pushing the latch member 34 back into the lock position is provided. With the spring 42, the latch handle assembly will correctly operate even if the operator applies a pressure on the handle member 6 to close the drawer 2. The rotary cam 40 advantageously amplifies the sliding movement of the latch member 34 for a given rotation of the handle member 6. Furthermore, it allows a positioning of the latch member 34 closer to the front panel 4 of the drawer 2, which reduces the space required for the mechanism. Moreover, the latch member 34 is outside the drawer 2 so it does not interfere with the slides of the drawer 2 whatsoever.

Figure 10:
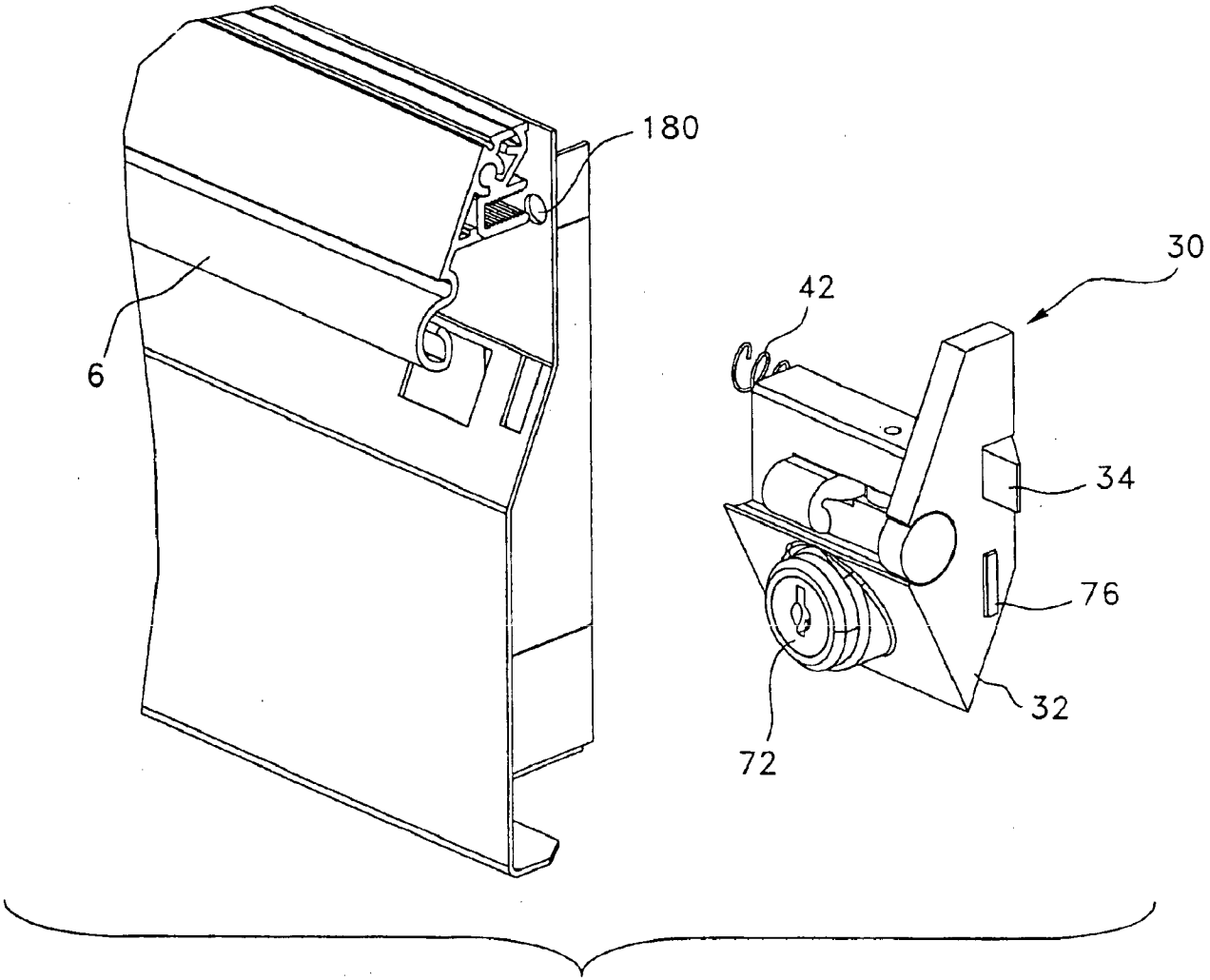
FIG. 10 is an exploded partial perspective view of a latch handle assembly in lock position according to the present invention.
Figure 11:
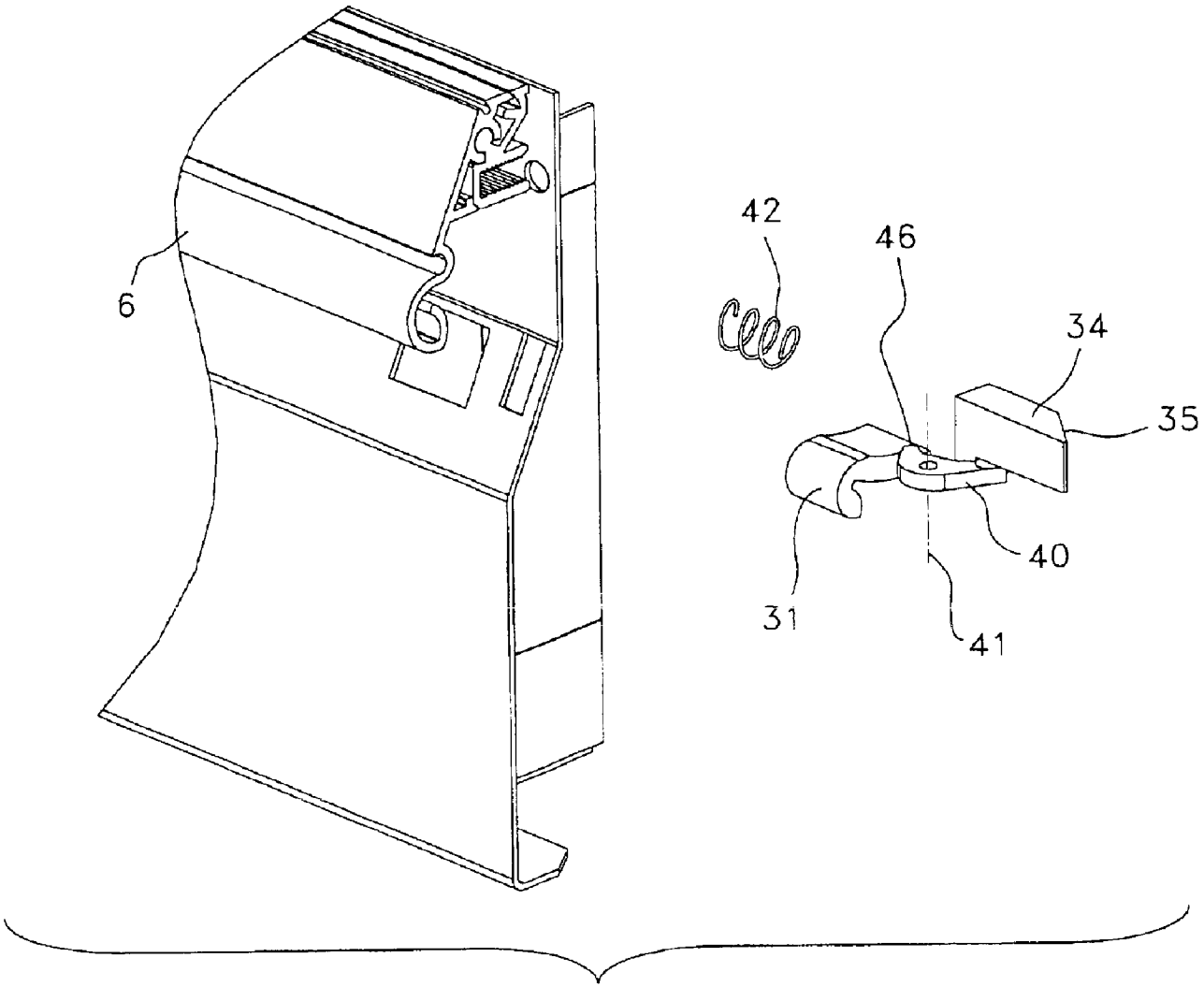
FIG. 11 is an exploded fragmentary perspective view of a latch handle assembly in lock position according to the present invention.

Referring to FIGS. 10–12, the abutment member 46 can be conveniently provided on a coupling member 31 having a hook-like end matching with and (slideably) fitting into the lower end of the handle member 6.

Referring to FIGS. 3 and 7, the latching mechanism may otherwise consist of a pin member 60 projecting rearward from the latch member 34, and a track element 62 coupled to the handle member 6 through the coupling block 36 and slideably guiding the pin member 60 so that the latch member 34 is pulled along the travelling course toward the unlock position by the pin 60 sliding along the track as a result of an upward swivelling of the handle member 6 (from the first position to the second position). The pin member 60 projects on a side of the latch member 34 and is provided with a terminal head 66. The track element 62 can be provided by an open channel 64 transversely sinking into the coupling block 36 and guiding the head 66 of the pin member 60 selectively closer to and away from the block member 32 depending on a direction of the swivelling of the handle member. In the illustrated case, the open channel 64 is a rearwardly oriented oblique channel for converting the pivotal movement of the handle member 6 into a linear travelling course of the latch member 34.

Referring to FIG. 3, the coupling block 36 and the handle member 6 have facing sides provided with complementary sets of pins 80 and sockets 82 spaced from one another so that the coupling block 36 can conveniently be affixed to the handle member 6 by engagement of the pins 80 in the sockets 82. Of course the positions of the pins 80 and the sockets 82 can be interchanged, and other kinds of fasteners can be used. Likewise, the coupling block 36 and the block member 32 have facing sides provided with a set of complementary pin 84 and socket extending in alignment with a pivot axis of the handle member 6 so that the coupling block 36 is pivotally mounted on the block member 32 by engagement of the pin 84 in the socket. Once again, the positions of the pin 84 and the socket may be interchanged and other kinds of pivotal attachment may also be used.

Figure 1:
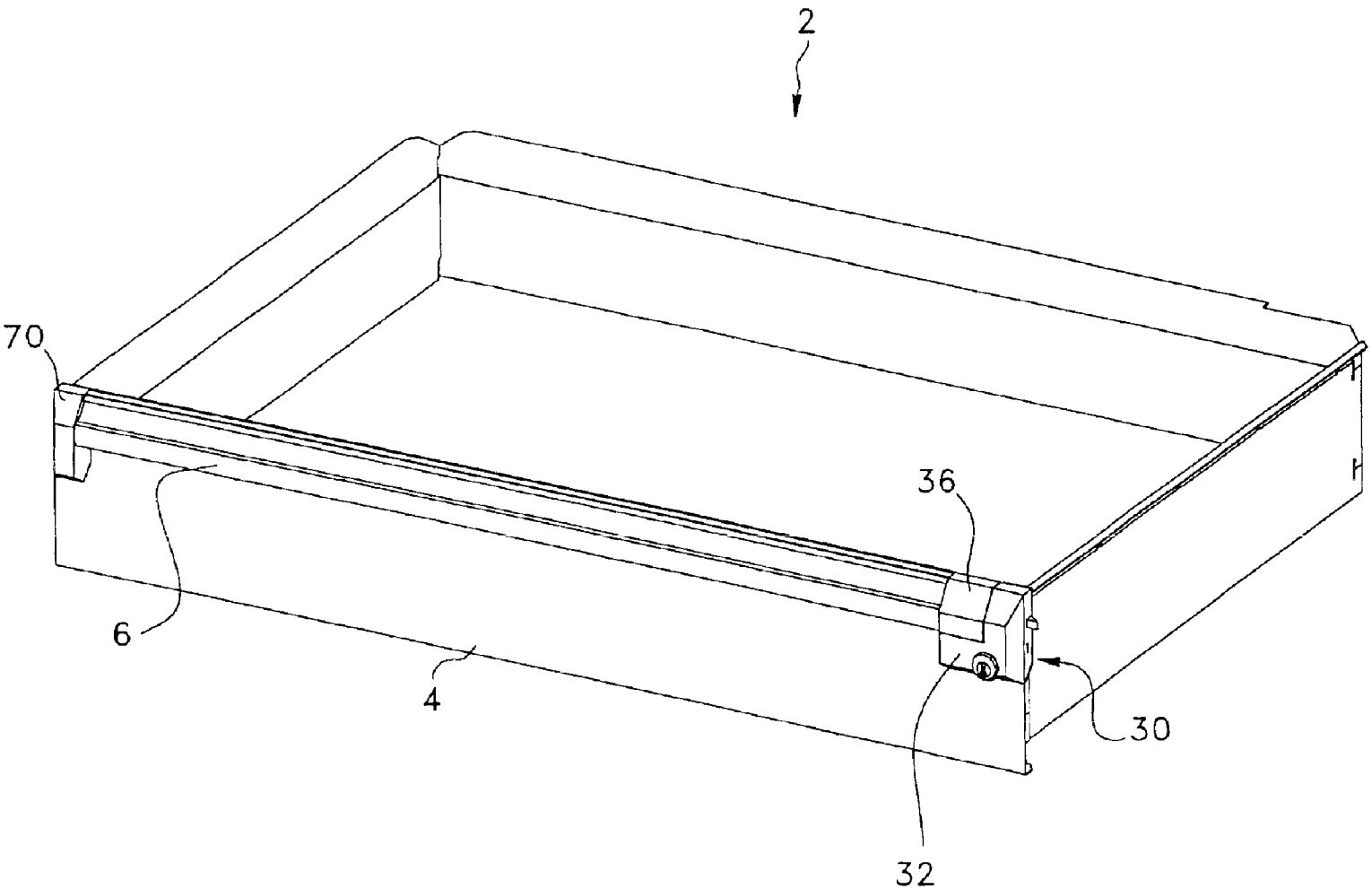
FIG. 1 is a perspective view of a drawer provided with a latch handle assembly according to the present invention.

Referring to FIG. 1, a mounting block 70 mountable on the front panel 4 of the drawer 2 is preferably provided at the end of the handle member 6 opposite to the end provided with the latching arrangement 30. The mounting block 70 pivotally receives one end of the handle member 6 while the coupling block 36 pivotally receives the opposite end of the handle member 6. The coupling block 36, the handle member 6 and the block member 32 preferably have profiles matching with one another. Moreover, the handle member 6 preferably has a length substantially corresponding to a width of the front panel 4 minus a width of the block member 32. It results that, when the frontal latch handle assembly is mounted onto the front panel 4, the block member 32 extends in longitudinal alignment with the handle member 6. The block member 32 is preferably substantially flush with a side edge of the front panel 4 with the latch member 34 projecting beyond the side edge when in the lock position and with the latch member 34 being slid in the block member 32 when in the unlock position.

Referring to FIGS. 4 and 5, the latch handle assembly is preferably provided with a key lock 72 controlling the opening of the drawer 2. The key lock 72 may be integrated to the block member 32 and provided with a securing bar 76 controllably sliding in and out of the block member 32. The key lock 72 can be arranged to controllably restrict motion of the latch member 34 instead of operating separately.

While embodiments of this invention have been illustrated in the accompanying drawings and described above, it will be evident to those skilled in the art that changes and modifications may be made therein without departing from the essence of this invention. For example, although the latch handle assembly illustrated in the Figures extends horizontally across the whole width of the drawer 2, it could be easily adapted to extend in a different direction, e.g. vertically. The handle member 6 may also be shorter if desired, instead of extending across the full width of the drawer 2. Also, the handle member 6 could be arranged to slide on the front panel 4 instead of pivoting, provided that the sliding motion is converted into the required motion for moving the latch member 34 between the lock and unlock positions. The handle member 6 can be mounted on the front panel 4 using only the mounting block 70 and the block member 32 if it is made of a sufficient stiff material. The coupling block 36 may be an integral part of the handle member 6. The shape and structure of the latching arrangement may differ from the illustrated embodiments so long as it provides suitable guidance for the latch member 34. All such modifications or variations are believed to be within the scope of the invention as defined by the claims appended hereto.

What is claimed is:

1. A frontal latch handle assembly for operating a drawer of a cabinet, the drawer having a front panel, comprising:

a handle member;

a means for movably mounting the handle member on the front panel of the drawer so that the handle member is movable between first and second positions;

a latching arrangement having a block member mountable on the front panel and a latch member movable with respect to the block member between a lock position wherein opening of the drawer is prevented by engaging the latch member with the cabinet, and an unlock position wherein the opening of the drawer is allowed; and a means responsive to movement of the handle member for moving the latch member between the lock and unlock positions, the means for movably mounting comprises a pivotal arrangement mountable on the front panel of the drawer and supporting the handle member so that the handle member is pivotable between the first and second positions.

2. The frontal latch handle assembly according to claim 1, wherein the pivotal arrangement comprises a pivot member having a front side to which the handle member is pivotally connected, and a rear side provided with a mounting element for attachment to the front panel of the drawer.

3. The frontal latch handle assembly according to claim 2, wherein the pivot member and the handle member respectively comprise first and second extrusions, the first extrusion having an upper longitudinal cylindrical cavity, the second extrusion having a rear cylindrical end fitted into the cylindrical joint cavity so that some degree of pivotal motion about a pivot axis is possible between the first and second extrusions, the degree of pivotal motion determining the first and second positions of the handle member.

4. The frontal latch handle assembly according to claim 2, wherein the pivot member and the handle member respectively comprise first and second extrusions, the first extrusion having a longitudinal cylindrical pivot element, the second extrusion having a rear longitudinal cylindrical socket pivoting on the cylindrical pivot member so that some degree of pivotal motion about a pivot axis is possible between the first and second extrusions, the degree of pivotal motion determining the first and second positions of the handle member.

5. The frontal latch handle assembly according to claim 2, wherein the mounting element comprises a longitudinal rearward slot having opposite inner thread elements.

6. The frontal latch handle assembly according to claim 1, wherein:

the block member guides the latch member along a linear travelling course between the lock and unlock positions; and the means responsive to movement comprises a rotary cam coupled to the handle member and engaging with the latch member so that the latch member is pulled along the travelling course toward the unlock position by a rotation of the rotary cam resulting from a swivelling of the handle member from the first position to the second position.

7. The frontal latch handle assembly according to claim 6, wherein the means responsive to movement comprises a spring urging the latch member along the travelling course toward the lock position.

8. The frontal latch handle assembly according to claim 6, wherein:

the means responsive to movement comprises a coupling block mounted at an end of the handle member and having an outwardly projecting abutment member directed toward the block member of the latching arrangement and in alignment with the latch member when the latch member is in lock position;

the latch member has an end provided with a projecting shoulder; and the rotary cam has an end pressing sideways against the abutment member of the coupling block, an opposite end hooking the shoulder of the latch member, and a rotation axis extending on a side of the travelling course.

9. The frontal latch handle assembly according to claim 6, wherein:

the means responsive to movement comprises a coupling member projecting from a lower end of the handle member behind the handle member, and having an outwardly projecting shoulder directed toward the block member of the latching arrangement;

the latch member has an end provided with a projecting shoulder; and the rotary cam has an end pressing sideways against the shoulder of the coupling member, an opposite end hooking the shoulder of the latch member, and a rotation axis extending on a side of the travelling course.

10. The frontal latch handle assembly according to claim 9, wherein the block member rotatively supports the rotary cam.

11. The frontal latch handle assembly according to claim 9, wherein the means responsive to movement comprises a spring extending in the block member and urging the latch member along the travelling course toward the lock position.

12. The frontal latch handle assembly according to claim 8, wherein:

the coupling block and the handle member have facing sides provided with complementary sets of pins and sockets spaced from one another so that the coupling block is affixed to the handle member by engagement of the pins in the sockets;

the coupling block and the block member have facing sides provided with a set of complementary pin and socket extending in alignment with the pivot axis of the handle member so that the coupling block is pivotally mounted on the block member by engagement of the pin in the socket; and the coupling block, the handle member and the block member have profiles matching one another.

13. The frontal latch handle assembly according to claim 1, wherein:

the block member guides the latch member along a linear travelling course between the lock and unlock positions; and the means responsive to movement comprises a pin member projecting rearward from the latch member, and a track element coupled to the handle member and slideably guiding the pin member so that the latch member is pulled along the travelling course toward the unlock position by the pin sliding on the track resulting from a swivelling of the handle member from the first position to the second position.

14. The frontal latch handle assembly according to claim 13, wherein:

the pin member has a terminal head; and the means responsive to movement comprises a coupling block mounted at an end of the handle member, the track element being provided by an open channel transversely sinking into the coupling block and guiding the head of the pin member selectively closer to and away from the block member depending on a direction of the swivelling of the handle member.

15. The frontal latch handle assembly according to claim 14, wherein:

the pin member projects on a side of the latch member; and the coupling block, the handle member and the block member have profiles matching one another.

16. The frontal latch handle assembly according to claim 1, wherein the block member has a back side having a longitudinal slot slideably guiding the latch member along a linear travelling course between the lock and unlock positions.

17. The frontal latch handle assembly according to claim 1, wherein the handle member has an elongated shape providing a corresponding hand operating surface.

18. The frontal latch handle assembly according to claim 17, wherein the handle member has a length substantially corresponding to a width of the front panel minus a width of a portion of the block member extending on a side of the handle member so that, when the frontal latch handle assembly is mounted onto the front panel, the block member extends in longitudinal alignment with the handle member and substantially flush with a side edge of the front panel with the latch member projecting beyond the side edge when in the lock position and with the latch member being slid in the block member when in the unlock position.

19. The frontal latch handle assembly according to claim 18, wherein the latch member has an exposed leading bevelled edge engaging with the cabinet when the drawer is closed.

20. The frontal latch handle assembly according to claim 19, wherein:

the handle member has first and second opposite ends; and the means for moveably mounting comprises a mounting block mountable on the front panel and pivotally receiving the first end of the handle member, the block member of the latching arrangement pivotally receiving the second end of the handle member.

21. The frontal latch handle assembly according to claim 1, wherein the block member of the latching arrangement comprises a key lock controlling the opening of the drawer.

* * * * *